US009404695B2

(12) United States Patent
Winge et al.

(10) Patent No.: US 9,404,695 B2
(45) Date of Patent: Aug. 2, 2016

(54) GAS SYSTEMS FOR FIREARMS

(71) Applicant: FOSTECH ARMS LLC, Seymour, IN (US)

(72) Inventors: Michael L Winge, Boonville, IN (US); Michael A Winge, Boonville, IN (US)

(73) Assignee: FOSTECH ARMS LLC, Seymour, IN (US)

( * ) Notice: Subject to any disclaimer, the term of this patent is extended or adjusted under 35 U.S.C. 154(b) by 0 days.

(21) Appl. No.: 14/573,540

(22) Filed: Dec. 17, 2014

(65) Prior Publication Data

US 2015/0323270 A1 Nov. 12, 2015

Related U.S. Application Data

(60) Provisional application No. 61/917,242, filed on Dec. 17, 2013.

(51) Int. Cl.

| | |
|---|---|
| ***F41A 5/26*** | (2006.01) |
| ***F41A 5/20*** | (2006.01) |
| ***F41A 3/36*** | (2006.01) |
| ***F41A 5/18*** | (2006.01) |
| *F41A 3/46* | (2006.01) |

(52) U.S. Cl.

CPC ... *F41A 5/26* (2013.01); *F41A 3/36* (2013.01); *F41A 5/18* (2013.01); *F41A 5/20* (2013.01); *F41A 3/46* (2013.01)

(58) Field of Classification Search

CPC ..... F41A 5/18; F41A 5/20; F41A 5/22; F41A 5/26; F41A 5/28

USPC ..... 89/191.01, 191.02, 192, 193

See application file for complete search history.

(56) References Cited

U.S. PATENT DOCUMENTS

| | | | | | |
|---|---|---|---|---|---|
| 2,865,256 | A * | 12/1958 | Marsh | F41A 3/62 | 89/191.01 |
| 3,242,812 | A * | 3/1966 | Maillard | F41A 3/40 | 89/44.01 |
| 5,404,790 | A * | 4/1995 | Averbukh | F41A 5/28 | 89/193 |

FOREIGN PATENT DOCUMENTS

| | | | |
|---|---|---|---|
| FR | 1.266.597 | * | 6/1961 |

* cited by examiner

*Primary Examiner* — Stephen M Johnson

(74) *Attorney, Agent, or Firm* — Roberts IP Law; John Roberts

(57) ABSTRACT

Provided in one aspect is an annular gas ring within or adjacent a barrel to increase the efficient transfer of pressurized gas to one or more gas ports, which may communicate the high-pressure gas to a piston to cycle the action of the firearm. Provided in another aspect are gas ports may adjacent the chamber, which may communicate pressurized gas from near the chamber to distally-extending gas tubes that communicate the pressurized gas to a distally located piston to cycle the action. A modular gas system is provided comprising a coupler that couples a barrel with a chamber and forms therebetween an annular gas ring with ports that communicate pressurized gas to separate longitudinally-extending cylindrical gas tubes that feed into a gas block that supports the barrel and forms the cylinder for the piston.

10 Claims, 6 Drawing Sheets

PRIOR ART

PRIOR ART

GAS SYSTEMS FOR FIREARMS

CROSS-REFERENCE TO RELATED APPLICATIONS

The present application claims priority to, incorporates herein by reference, and is a non-provisional of co-pending U.S. Patent Application No. 61/917,242, filed Dec. 17, 2013.

FEDERALLY SPONSORED RESEARCH OR DEVELOPMENT

None.

TECHNICAL FIELD

This invention relates to firearms, and in particular to improved gas systems for firearms.

BACKGROUND

Gas-operation is a system used to provide energy to operate auto-loading firearms. In gas-operation, a portion of high pressure gas from the cartridge being fired is used to power a mechanism to extract the spent case and chamber a new cartridge. Energy from the gas is harnessed through either a port in the barrel or trap at the muzzle. This high-pressure gas impinges on a movable surface such as a piston head to provide motion for unlocking the action, extracting and ejecting the spent case, cocking the hammer or striker, chambering a fresh cartridge, and locking the action.

Most current gas systems employ some type of piston. The face of the piston is acted upon by gas from the combustion of the propellant from the barrel of the firearm. Early methods such as Browning's 'flapper' prototype, the Bang rifle, and Garand rifle used relatively low-pressure gas from at or near the muzzle, where the bullet exits the barrel. This, combined with more massive operating parts, reduced the strain on the mechanism. To simplify and lighten the firearm, gas from nearer the chamber needed to be used. This gas is of extremely high pressure and has sufficient force to destroy a firearm unless it is regulated somehow. Several methods are employed to regulate the energy. The M1 carbine incorporates a very short piston, or "tappet". This movement is closely restricted by a shoulder recess. Excess gas is then vented back into the bore. The M14 rifle and 60 GPMG use the White expansion and cutoff system to stop (cut off) gas from entering the cylinder once the piston has traveled a short distance. Most systems, however, vent excess gas into the atmosphere through slots, holes, or ports.

With a long-stroke system, the piston is mechanically fixed to the bolt group and moves through the entire operating cycle. This system is used in weapons such as the Bren light machine gun, AK-47, Tavor, M249 Squad Automatic Weapon, FN MAG, M1 Garand, and various semi-automatic shotguns, for example. The primary advantage of the long-stroke system, beyond design simplicity and robustness, is that the mass of the piston rod adds to the momentum of the bolt carrier enabling more positive extraction, ejection, chambering, and locking. Also, as the gas is not directed back into the chamber, the weapon stays cleaner longer thus reducing the likelihood of a malfunction.

Simplified section views of a typical gas-operation system in use are depicted in FIGS. 1A-1E. A typical long-stroke gas-operation system 100 of a firearm may comprise a barrel 105 having a gas port 110 located distally down the barrel 105, well away from the chamber 170. The gas port 110 vents part of the pressurized gas 165 resulting from the firing of gunpowder 155 causing a bullet or other projectile(s) 150 (herein collectively, "bullet 150") to travel down the barrel 105 from a proximal end near the chamber 170 to a distal end where the bullet exits the barrel 105 through a muzzle (not shown). The gas port 110 typically vents a small portion of the pressurized gas 165 into an adjacent cylinder 115 just beyond a piston 120 located in the cylinder 115, as depicted in FIGS. 1B-1D. The piston 120 is typically connected by a piston rod or operation rod 125 to a bolt carrier 130, those parts together comprising a carrier assembly that typically slides in the opposite direction of the bullet 150 (i.e., rearward, or to the right in the Figures) when the pressurized gas 165 travels down the barrel 105 behind the bullet 150, through the gas port 110, into the cylinder 115, and impinges on the face of the piston 120, as depicted in FIGS. 1B-1D. The momentum of the rearward travel of the bolt carrier assembly typically causes the bolt carrier 130 to unlock a locking block 145 that locks the bolt 140 to the chamber 170 (i.e., unlocks the "action"), and then the bolt carrier 130 pushes the bolt 140 backwards (to the right in the Figures) away from the chamber 170, while expelling the spent casing 160 and introducing a new cartridge with bullet 150 into the chamber 170, as depicted in FIG. 1E. The rearward travel of the carrier assembly is typically increasingly resisted by a spring 135, which then urges the carrier assembly to travel back in the forward direction (to the left in the Figures, FIG. IF), re-locking the bolt 140 to the chamber 170, whereupon the firearm returns to the position shown in FIG. 1A, ready to fire again.

One disadvantage of this type of system 100 is that, due to the significant mass of moving parts, a significant amount of high-pressure gas 165 is required to operate the system 100. In order to transmit the required volume of high-pressure gas 165 to the piston 120, manufacturers utilize various numbers of gas ports 110 of different sizes, typically located near or distally (to the left in the Figures) of the resting position of the piston 120 to allow the high-pressure gas 165 to flow backward (to the right in the Figures) against the face of the piston 120. There are some key limitations to this type of system 100. First, these small ports 110 are prone to clogging due to debris created when a round or bullet 150 is fired. Clogged ports 110 can cause the firearm to cease functioning as intended.

Second, the size and/or number of ports 110 can directly affect the types of loads that can be used. If the ports 110 are small or there are few of them it is more difficult for high-pressure gas 165 to be redirected to the piston 120. This results in the firearm requiring heavy loads (high-powered cartridges) in order for the gas-operation system 100 of the firearm to cycle. Alternatively, if ports 110 are larger or more numerous then gas 165 is more easily redirected, which can allow the firearm to cycle lighter loads (lower-powered cartridges). However, where large ports 110 are used, heavy loads may cause excessive wear on the firearm due to exposing the face of the piston 120 to an excessive volume of high-pressure gas 165 directly from the interior of the barrel 105.

A third limitation of typical systems 100 is the distal location of the ports 110. By placing the ports 110 in a distal portion of the barrel 150 (distally from the firing chamber 170) adjacent or beyond the resting position of the piston 120, the pressure of the high pressure gas 165 available at the ports 110 is greatly reduced and is widely variable depending on the power of the cartridge 150. Thus, present systems 100 provide inefficient and inconsistent capturing and transmission of high-pressure gas 165.

SUMMARY

Provided is a novel structure, system, and method for gas-operating firearms that elegantly overcomes the problems of the prior art while providing other advantages. Provided in various example embodiments is a gas system for a firearm having a barrel, comprising: one or more gas ports in gaseous communication with high-pressure gas in the interior of a firearm through an annular gas ring, the one or more gas ports in gaseous communication with a piston adapted to cycle the firearm using the high-pressure gas communicated through the one or more gas ports; wherein the annular gas ring comprises a longitudinally-extending segment through which a projectile fired by the firearm travels, the annular gas ring having a diameter larger than an inner diameter of the barrel. In various example embodiments the gas system may further comprise the annular gas ring positioned proximate a chamber adapted to house a cartridge to be fired by the firearm. In various example embodiments the gas system may further comprise the piston being located distally from the annular gas ring and the one or more gas ports being in gaseous communication with the piston through one or more longitudinally-extending gas tubes. In various example embodiments the gas system may further comprise the annular gas ring being formed in the inner diameter of the barrel. In various example embodiments the gas system may further comprise the annular gas ring being formed in the inner diameter of a chamber housing adapted to house a cartridge to be fired by the firearm. In various example embodiments the gas system may further comprise the annular gas ring being formed between a proximate end of the barrel and a distal end of a chamber housing adapted to house a cartridge to be fired by the firearm. In various example embodiments the gas system may further comprise a coupler comprising a longitudinally-extending inner circumferential surface open on two ends, a first end of the coupler adapted to receive therein the proximate end of the barrel, and a second end of the coupler adapted to receive therein the distal end of the chamber housing, such that the proximate end of the barrel and the distal end of the chamber housing are located proximate but separated from each other by a predetermined longitudinal distance within the coupler. In various example embodiments the gas system may further comprise the one or more ports being formed in the coupler. In various example embodiments the gas system may further comprise the piston being located distally from the annular gas ring and the one or more gas ports being in gaseous communication with the piston through one or more longitudinally-extending gas tubes. In various example embodiments the gas system may further comprise the one or more longitudinally-extending gas tubes comprising hollow cylinders separable from the rest of the firearm. In various example embodiments the gas system may further comprise the one or more gas ports in gaseous communication with the piston through a gas block, the gas block adapted to be in gaseous communication with the one or more longitudinally-extending gas tubes and with a cylinder housing the piston. In various example embodiments the gas system may further comprise the gas block further adapted to surround and support the barrel. In various example embodiments the gas system may further comprise the gas block and the cylinder housing the piston being one piece.

Provided in another example embodiments is a modular gas system for a firearm having a barrel, comprising: one or more gas ports in gaseous communication with high-pressure gas in the interior of a firearm, the one or more gas ports in gaseous communication with a piston adapted to cycle the firearm using the high-pressure gas communicated through the one or more gas ports; the one or more gas ports positioned proximate a chamber adapted to house a cartridge to be fired by the firearm; the piston located distally from the one or more gas ports; and the one or more gas ports in gaseous communication with the piston through one or more longitudinally-extending gas tubes. In various example embodiments the modular gas system may further comprise a coupler comprising a longitudinally-extending inner circumferential surface open on two ends, a first end of the coupler adapted to receive therein a proximate end of the barrel, and a second end of the coupler adapted to receive therein a distal end of a chamber housing, the chamber housing comprising therein a chamber adapted to house a cartridge to be fired by the firearm, the proximate end of the barrel and the distal end of the chamber housing located proximate but separated from each other by a predetermined longitudinal distance within the coupler. In various example embodiments the modular gas system may further comprise the one or more ports being formed in the coupler. In various example embodiments the modular gas system may further comprise the one or more longitudinally-extending gas tubes comprising hollow cylinders separable from the rest of the firearm. In various example embodiments the modular gas system may further comprise the one or more gas ports in gaseous communication with the piston through a gas block, the gas block adapted to be in gaseous communication with the one or more longitudinally-extending gas tubes and with a cylinder housing the piston. In various example embodiments the modular gas system may further comprise the gas block being further adapted to surround and support the barrel. In various example embodiments the modular gas system may further comprise the gas block and the cylinder housing the piston being one piece.

The foregoing summary is illustrative only and is not meant to be exhaustive or limiting. Other aspects, objects, and advantages of various example embodiments will be apparent to those of skill in the art upon reviewing the accompanying drawings, disclosure, and appended claims.

DETAILED DESCRIPTION OF EXAMPLE EMBODIMENTS

Figure 1A:
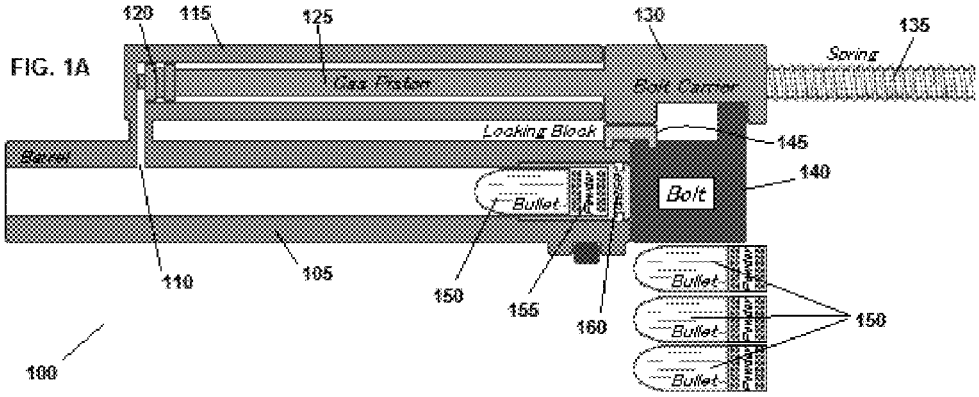
FIG. 1A is a side elevation section view of a simplified long-stroke gas-operation system of known firearms, shown loaded and ready to fire.
Figure 1B:
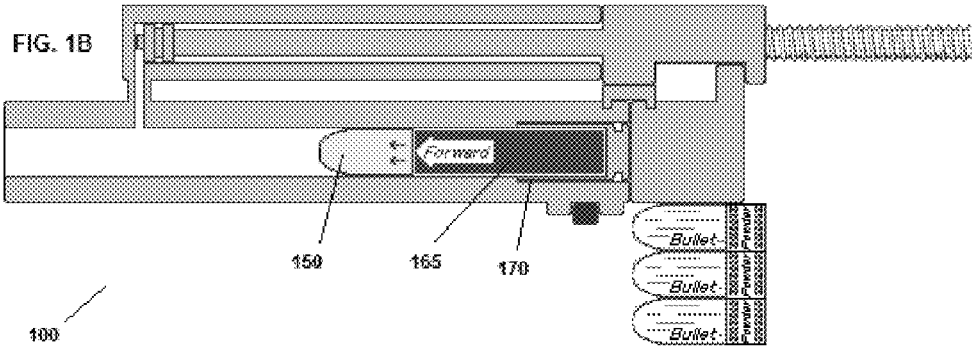
PRIOR ART FIG. 1B
FIG. 1B is a side elevation section view of the system of FIG. 1A, shown immediately after firing, as a bullet leaves the firing chamber and begins to travel down the barrel.
Figure 1C:
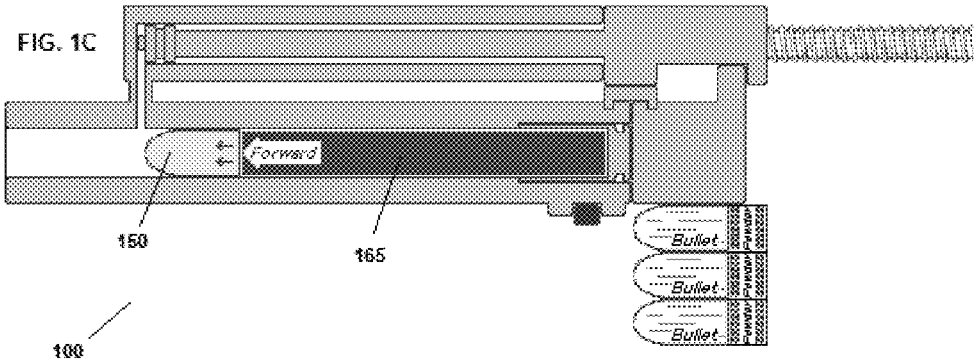
PRIOR ART FIG. 1C
FIG. 1C is a side elevation section view of the system of FIG. 1B, shown a short time later, as the bullet travels distally down the barrel.
Figure 1D:
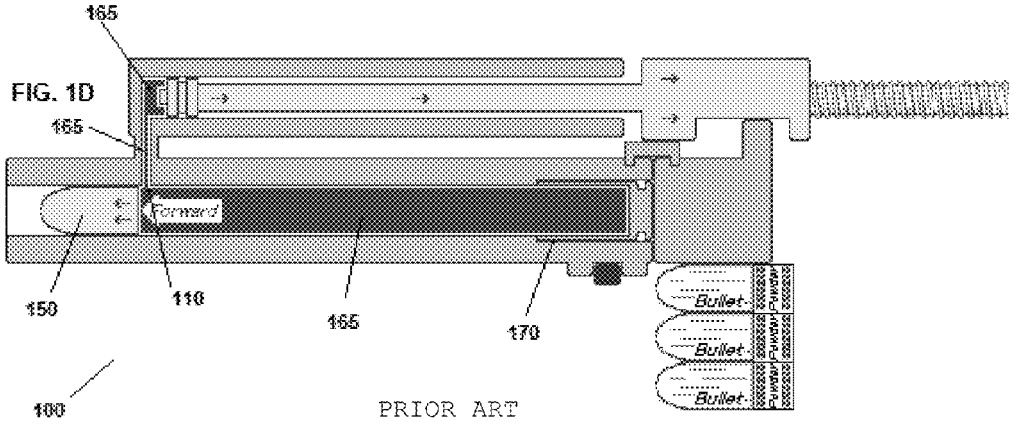
FIG. 1D is a side elevation section view of the system of FIG. 1C, shown a short time later, as the bullet travels past a gas port, allowing high-pressure gas behind the bullet to travel through the gas port to impinge on a piston, thereby causing a carrier assembly to begin to move backward (i.e., to the right).
Figure 1E:
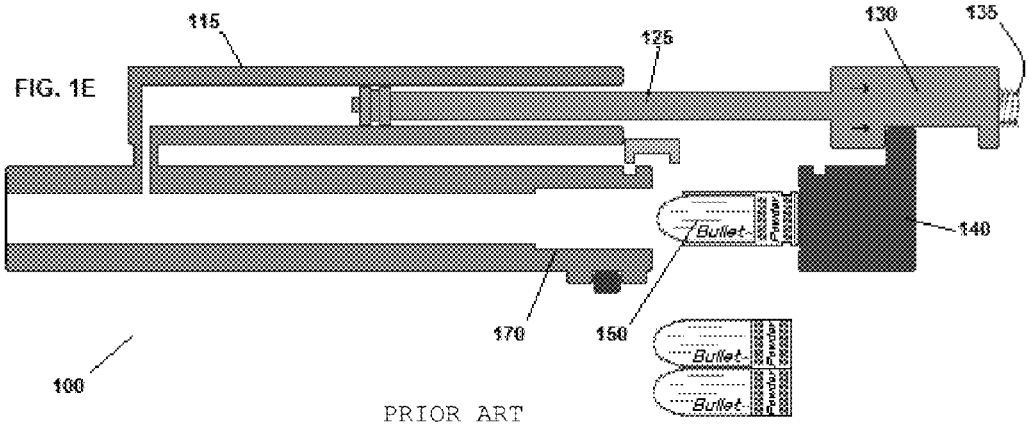
PRIOR ART FIG. 1E
FIG. 1E is a side elevation section view of the system of FIG. 1D, shown a short time later, as the carrier assembly continues to move backward (to the right) via momentum, thereby actuating the action of the firearm to automatically reload the firearm.
Figure 1F:
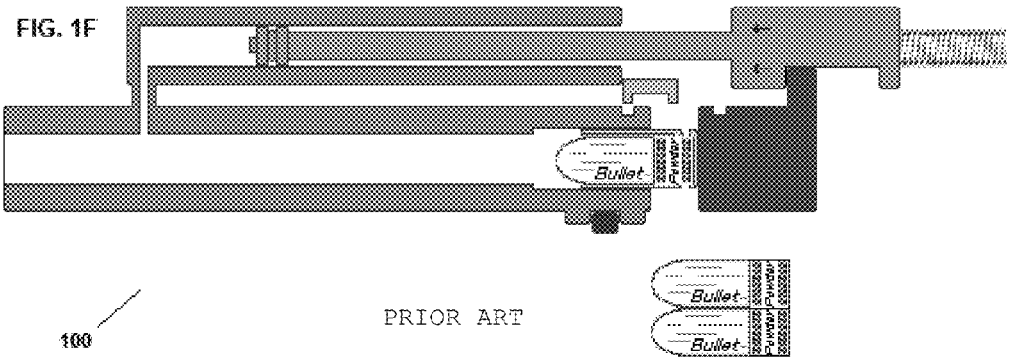
PRIOR ART FIG. 1F
FIG. 1F is a side elevation section view of the system of FIG. 1E, shown a short time later, as the carrier assembly returns toward its starting position as shown in FIG. 1A.

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Referring now in detail to the drawings wherein like elements are indicated by like numerals, there are shown various aspects of example firearms with improved gas systems. With respect to the example embodiments shown in FIGS. 2A-2E, 3 and 4, in one aspect gas systems 200, 300 may be provided with gas ports 210, 310 that may be in gaseous communication with high-pressure gas 165 in the interior of a firearm through an annular gas ring 207, 307. Annular gas ring 207, 307 may comprise a longitudinally-extending segment through which the projectile 150 travels, which has a diameter larger than the inner diameter of the barrel 205, 305. An annular gas ring 207, 307 can be machined or otherwise formed into the inner diameter of the barrel 205, 305 or the chamber housing 371, or may be defined by a member connecting the barrel 305 with the firing chamber 370, such as a coupler 390 (shown in FIGS. 3 and 4). Annular gas ring 207, 307 may have any suitable cross-sectional profile, such as curved, angled, or squared-off, and may be defined by a locus of points separated from the centerline of the barrel 205, 305 by a constant radial distance, or may have a variable radial distance, for instance increasing near the one or more gas ports 210, 310. It has been found that locating gas ports 210, 310 in annular gas rings 207, 307 surprisingly improves the efficiency with which high-pressure gas 165 is captured and directed into the gas ports 210, 310.

In another example aspect of improved gas systems 200, 300, one or more gas ports 210, 310 may be positioned proximate the firearms' respective chambers 170, 370. In these example embodiments, high-pressure gas 165 may be communicated from the highest pressure region in the firearm, near the chamber 170, 370, through one or more gas ports 210, 310, into one or more gas tubes 215, 365 that communicate the high-pressure gas 165 from proximate the chamber 170, 370 area, distally to a distally located piston 120, 320. This has been found to provide the surprising benefit of almost instantaneously communicating to piston 120, 320 high-pressure gas 165 having significantly improved consistency in pressure, regardless whether heavy or light loads are used, while providing sufficient energy to drive piston 120, 320 even when very light loads are used.

Figure 2A:
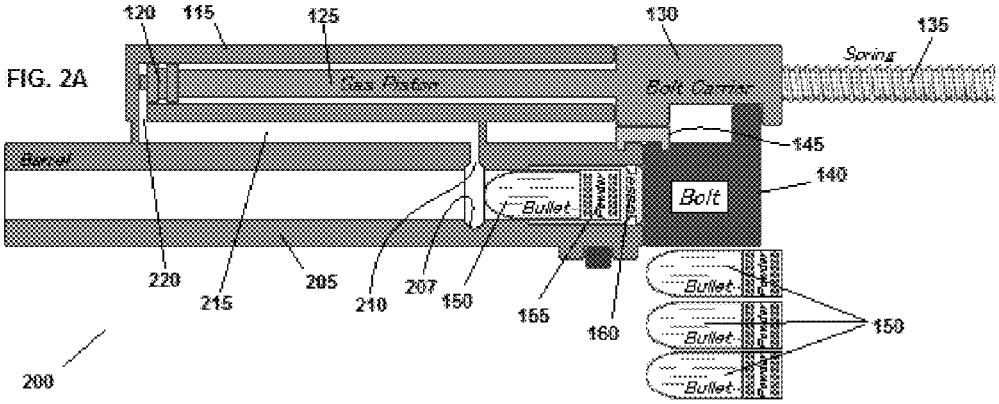
FIG. 2A is a side elevation section view of a simplified long-stroke gas-operation system of a firearm improved according to various example embodiments of the present disclosure, shown loaded and ready to fire.
Figure 2B:
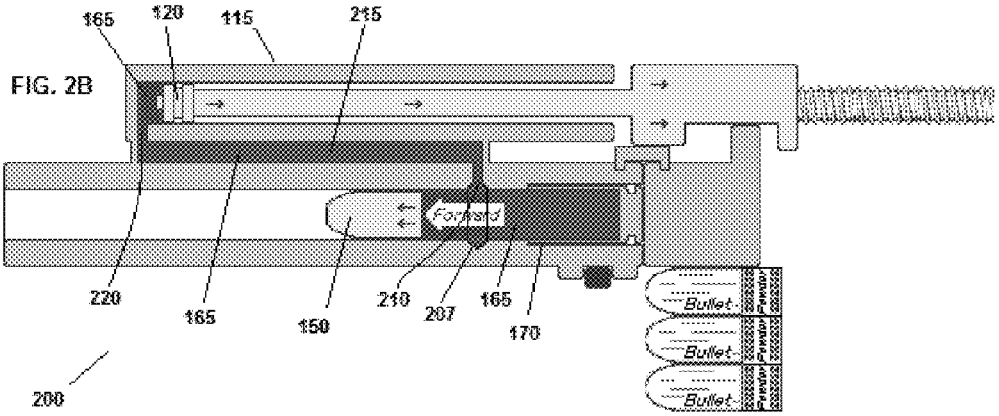
FIG. 2B is a side elevation section view of the system of FIG. 2A, shown immediately after firing, as a bullet leaves the firing chamber and begins to travel down the barrel, as the bullet travels past a gas port formed in an internal annular ring, allowing high-pressure gas behind the bullet to travel through the gas port, through a gas tube, to impinge on a piston, thereby causing a carrier assembly to begin to move backward (i.e., to the right).
Figure 2C:
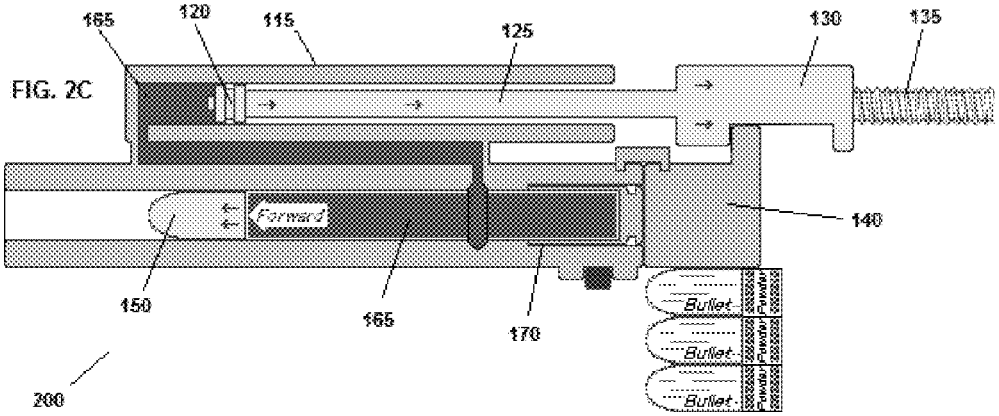
FIG. 2C is a side elevation section view of the system of FIG. 2B, shown a short time later, as the carrier assembly continues to move backward (to the right) and begins to engage the action of the firearm.

With continuing reference to the example embodiment of an improved gas system 200 shown FIGS. 2A-2E, which illustrates multiple aspects, in use one or more gas ports 210 vent part of the pressurized gas 165 resulting from the firing of gunpowder 155 causing a bullet or other projectile(s) 150 (herein collectively, "bullet 150") to travel down the barrel 205 from a proximal end near the chamber 170 to a distal end where the bullet exits the barrel 205 through a muzzle (not shown). A portion of the high-pressure gas 165 proximate the chamber 170 is efficiently captured and directed into the one or more gas ports 210 by annular gas ring 207, which is shown formed in the interior of the barrel 205 and proximate the chamber 170 in this embodiment. The one or more gas ports 210 communicate high-pressure gas 165 distally through one or more gas tubes 215, through one or more cylinder ports 220, into the cylinder 115, where the high-pressure gas 165 impinges on the face of the piston 120, as depicted in FIGS. 2B-2C, all before the bullet 150 travels distally to the resting location of the piston 120. This is an improvement over prior devices 100 that only begin to communicate high-pressure gas 165 to the piston 120 after the bullet 150 travels further down the barrel, typically distally near or past the end of the piston 120, compare FIGS. 1A-1D.

Figure 2D:
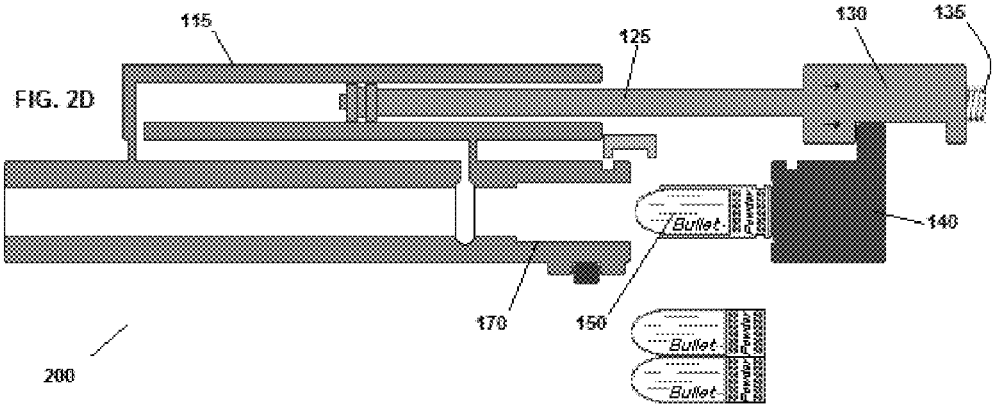
FIG. 2D is a side elevation section view of the system of FIG. 2C, shown a short time later, as the carrier assembly continues to move backward (to the right) via momentum, thereby actuating the action of the firearm to automatically reload the firearm.
Figure 2E:
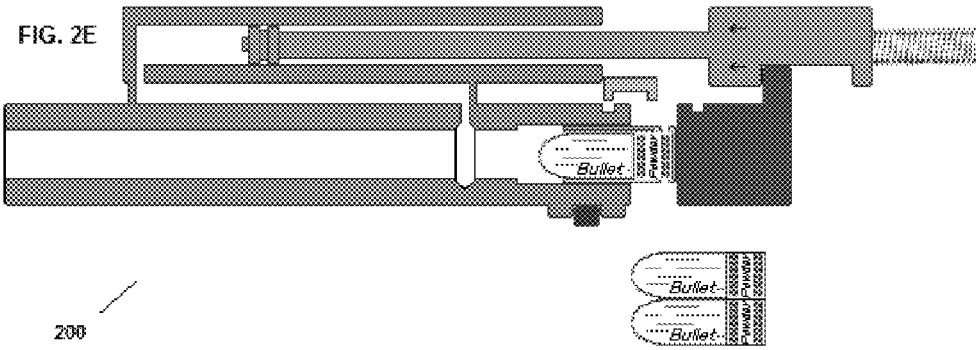
FIG. 2E is a side elevation section view of the system of FIG. 2D, shown a short time later, as the carrier assembly returns toward its starting position as shown in FIG. 2A.

In various example embodiments, the piston 120 may be connected by a piston rod or operation rod 125 to a bolt carrier 130, those parts together comprising a carrier assembly that may slide in the opposite direction of the bullet 150 (i.e., rearward, or to the right in the Figures) when the pressurized gas 165 travels down the barrel 205 behind the bullet 150, through the gas ports 210, through the gas tubes 215, through one or more cylinder ports 220 into the cylinder 115, where it impinges on the face of the piston 120, as depicted in FIGS. 2B-2C. In various example embodiments the momentum of the rearward travel of the bolt carrier assembly may cause the bolt carrier 130 to unlock a locking block 145 that locks the bolt 140 to the chamber 170 (i.e., unlocks the "action"), followed by the bolt carrier 130 pushing the bolt 140 backwards (to the right in the Figures) away from the chamber 170, while expelling the spent casing 160 and introducing a new cartridge with bullet 150 into the chamber 170, as depicted in FIG. 2D. The rearward travel of the carrier assembly may be increasingly resisted by a spring 135, which may then urge the carrier assembly to travel back in the forward direction (to the left in the Figures, FIG. 2E), re-locking the bolt 140 to the chamber 170, whereupon the firearm returns to the position shown in FIG. 2A, ready to fire again.

Since the present system 200 can communicate pressure to the piston 120 more quickly than prior systems 100, the present system 200 may be adapted to cycle more rapidly than prior devices 100 as shown in FIGS. 1A-1D. Additionally, by tapping into the highest available pressure gas 165 near the chamber 170, efficiently capturing and directing that highest-pressure gas with an annular gas ring 207, and then communicating that highest-pressure gas 165 through distally-extending gas tubes 215 and cylinder ports 220, the volume and pressure of gas 165 available at the piston 120 may be significantly improved in consistency, regardless whether heavy or light loads are used, while reliably providing sufficient energy to drive piston 120, 320 even when very light loads are used.

Figure 3:
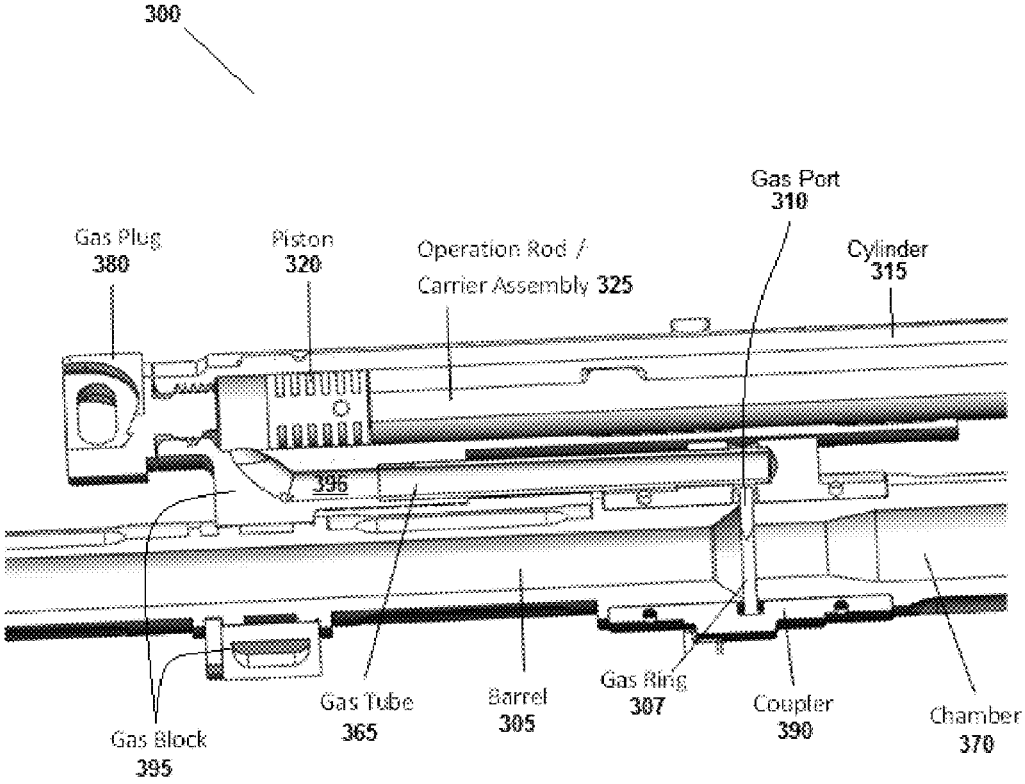
FIG. 3 is a side elevation section view of a long-stroke gas-operation system of a firearm improved according to various example embodiments of the present disclosure.
Figure 4:
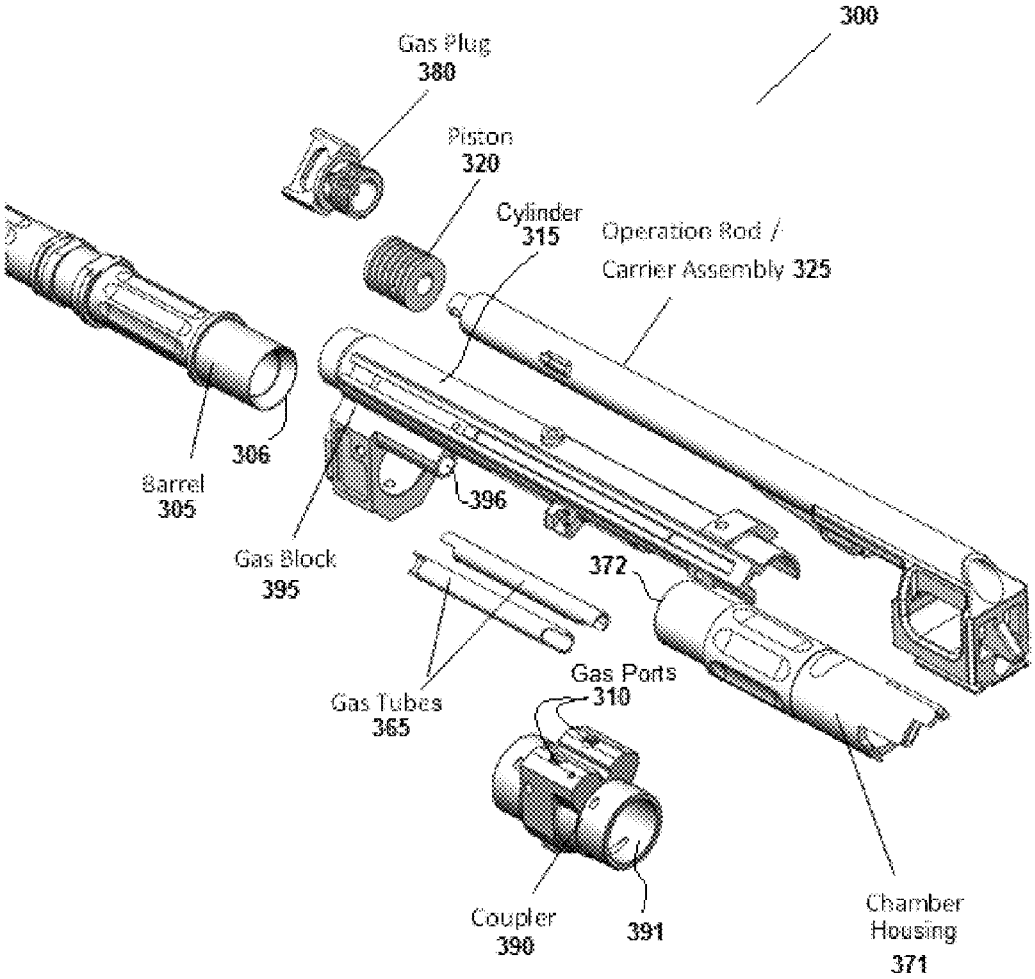
FIG. 4 is an exploded perspective view of the example system of FIG. 3, showing various example components.

Certain details regarding another example embodiment are illustrated in FIGS. 3 and 4. Operating as set forth above with respect to example gas system 200, an example gas system may comprise a modular system 300 comprising a barrel 305 having a proximate end 306, a chamber housing 371 defining therein a chamber 370 and having a distal end 372, a coupler 390 comprising a longitudinally-extending inner circumferential surface 391 open on two ends, one end of the coupler 390 adapted to receive therein the proximate end 306 of the barrel 305, and the other end of the coupler 390 adapted to receive therein the distal end 372 of the chamber housing 371, such that the proximate end 306 of the barrel 305 and the distal end 372 of the chamber housing 371 are located proximate but separated from each other by a predetermined longitudinal distance within the coupler 390. When assembled as shown in FIG. 3, the space within the coupler 390 defined between the proximate end 306 of the barrel 305 and the distal end 372 of the chamber housing 371 is annular gas ring 307, into which gas ports 310 are formed. Gas ports 310, formed in coupler 390, may be adapted to be in gaseous communication with respective longitudinally-extending cylindrical gas tubes 365 each having their own body, which may be adapted to be in further gaseous communication with gas block 395, which may comprise corresponding cylinder ports 396 (FIG. 3) in gaseous communication with the face of piston 320 within cylinder 315. Gas block 395 may be adapted to surround and support the outer diameter of barrel 305 and may be formed as one-piece with the cylinder 315 (FIG. 4). For ease of maintenance and manufacture a removable and replaceable gas plug 380 may be located in the distal end of cylinder 315 to access the interior of cylinder 315. Piston 320 may be attached with operation rod / carrier assembly 325, which may function in a firearm as described above with respect the corresponding parts illustrated in FIGS. 2A-2E, or in any other suitable manner. In other embodiments, longitudinally-extending gas tubes 365 may not have their own body, and may be formed as part of another component, for instance as a through-hole or chamber formed in another component, for instance as shown in gas tube 215 in FIG. 2A.

It is understood that the above-described embodiments are merely illustrative of the application. Other embodiments may be readily devised by those skilled in the art, which may embody one or more aspects or principles of the invention and fall within the scope of the claims.

What is claimed is:

1. A long-stroke gas system for a firearm having a chamber from which projectiles are fired into a barrel having a distal end where the projectiles exit the barrel when fired, comprising:

a piston having a piston head that when in a forward-most position is located closer to the distal end of the barrel than to the chamber, the piston adapted to cycle the firearm using pressurized gas from proximate the chamber, wherein the gas from proximate the chamber is communicated through an annular gas ring proximate the chamber, through one or more gas ports, through one or more longitudinally extending gas tubes located outside the barrel and extending distally to proximate the piston head at the forward-most position of the piston head, and into a cylinder housing the piston head;

wherein the annular gas ring comprises a longitudinally-extending segment through which the projectiles fired by the firearm travel, the annular gas ring having a diameter larger than an inner diameter of the barrel.

2. The long-stroke gas system of claim 1, further comprising:

wherein the annular gas ring is formed in an inner diameter of the barrel.

3. The long-stroke gas system of claim 1, further comprising:

wherein the annular gas ring is formed in an inner diameter of the chamber.

4. The long-stroke gas system of claim 1, further comprising:

wherein the annular gas ring is formed between a proximate end of the barrel and a distal end of the chamber.

5. The long-stroke gas system of claim 4, further comprising:

a coupler comprising a longitudinally-extending inner circumferential surface open on two ends, a first end of the coupler adapted to receive therein a proximate end of the barrel, and a second end of the coupler adapted to receive therein a distal end of a chamber housing, such that the proximate end of the barrel and the distal end of the chamber housing are located proximate but separated from each other by a predetermined longitudinal distance within the coupler.

6. The long-stroke gas system of claim 5, further comprising:

wherein the one or more gas ports are formed in the coupler.

7. The long-stroke gas system of claim 1, further comprising:

wherein the one or more longitudinally-extending gas tubes comprise hollow cylinders separable from the rest of the firearm.

8. The long-stroke gas system of claim 7, further comprising:

the one or more gas ports in gaseous communication with the piston head through a gas block, the gas block adapted to be in gaseous communication with the one or more longitudinally-extending gas tubes and with the cylinder housing the piston head.

9. The long-stroke gas system of claim 8, further comprising:

the gas block further adapted to surround and support the barrel.

10. The long-stroke gas system of claim 8, further comprising:

wherein the gas block and the cylinder housing the piston head are one piece.

* * * * *